United States Patent [19]

Corey

[11] 4,284,227

[45] Aug. 18, 1981

[54] EXPANSION FOLDER WITH ACCORDIAN-PLEAT BACKBONE

[75] Inventor: Joseph T. Corey, Williamsville, N.Y.

[73] Assignee: Permclip Products Corporation, Buffalo, N.Y.

[21] Appl. No.: 103,277

[22] Filed: Dec. 13, 1979

[51] Int. Cl.[3] ..... B65D 37/00; B42F 7/02

[52] U.S. Cl. ..... 229/1.5 R; 229/DIG. 3; 229/DIG. 4; 281/29

[58] Field of Search ..... 229/1.5 R, DIG. 3, DIG. 4; 281/11, 29, 35, 36

[56] References Cited

U.S. PATENT DOCUMENTS

| | | | |
|---|---|---|---|
| 643,866 | 2/1900 | Burrows . | |
| 1,721,344 | 7/1929 | Klopp | 281/29 X |
| 1,745,249 | 1/1930 | Doughty | 229/1.5 R |
| 1,745,461 | 2/1930 | Trussell . | |
| 2,109,882 | 3/1938 | Gram | 229/1.5 R |
| 2,289,949 | 7/1942 | Wisdom | 229/1.5 R |
| 2,486,330 | 10/1949 | Schade | 281/29 |
| 2,693,894 | 11/1954 | Elmendorf | 229/1.5 R |
| 2,772,427 | 12/1956 | Rankin | 11/2 |
| 3,087,498 | 4/1963 | Vogel | 229/1.5 R |

FOREIGN PATENT DOCUMENTS 1123779 8/1968 United Kingdom .

*Primary Examiner*—Stephen Marcus
*Attorney, Agent, or Firm*—Joseph P. Gastel

[57] ABSTRACT

A backbone construction for a file folder including a pair of parallel grooves on the inside of the folder between the backbone portion and the front and rear leaves, slots extending inwardly from the ends of the backbone portion, a flexible tape overlying both the inner and outer surfaces of the backbone and the inner and outer surfaces of the front and rear covers adjacent to the grooves, an elongated slit located centrally between the grooves and parallel thereto and extending through the tape on the inner surface of the backbone and through a portion of the backbone and being in line with the slots, and perforations located between the ends of the slit and the slots.

12 Claims, 11 Drawing Figures

EXPANSION FOLDER WITH ACCORDIAN-PLEAT BACKBONE

BACKGROUND OF THE INVENTION

The present invention relates to an improved expansion folder of the type having an accordian-pleat backbone structure.

By way of background, there is commonly in use at the present time an expansion type folder, also known as a pressboard folder, which comprises a front and rear cover fastened to each other by a fabric tap which has an accordian pleat therein. However, the accordian pleat loses its stiffness in use and eventually becomes extremely limp so that it can invert from its normal inward orientation between the covers to an orientation wherein it lies outside of the covers and therefore presents an extremely sloppy appearance. It is with overcoming the deficiency of the foregoing type of folder that the present invention is concerned.

SUMMARY OF THE INVENTION

It is accordingly one object of the present invention to provide an improved expansion folder with an accordian-pleat backbone wherein the backbone is fabricated in such a manner so that it will not become limp and will always fold inwardly between the covers when the file folder is in a closed condition.

Another object of the present invention is to provide an improved folder with an accordian-pleat backbone in which the reinforcing arrangement which maintains the backbone in a strengthened condition will not interfere with the folding action of the backbone. Other objects and attendant advantages of the present invention will readily be perceived hereafter.

The present invention relates to a backbone construction for a folder having front and rear covers and a backbone integral with said covers comprising a backbone portion having an inner surface and an outer surface, a first groove between said front cover and said inner surface of said backbone portion, a second groove between said rear cover and said inner surface of said backbone portion, said first and second grooves defining the outer peripheral sides of the inner surface of said backbone portion, first and second ends on said backbone portion extending between said first and second grooves, first and second slots located between said first and second grooves and extending inwardly from said first and second ends, respectively, toward each other, planar sheet material overlying said inner surface and said first and second grooves and said first and second slots, and portions of said front and rear covers adjacent to said first and second slots, a perforation located at the inner end of each of said first and second slots, respectively, and extending through said backbone portion and said planar sheet material, and an elongated slit extending between said first and second perforations and through said planar material and partially through said backbone portion on said inner surface thereof to cause said backbone portion to flex inwardly in accordian-pleat fashion between said front and rear covers. The present invention will be more fully understood when the following portions of the specification are read in conjunction with the accompanying drawings wherein:

DESCRIPTION OF THE PREFERRED EMBODIMENT

Figures 1, 2, 3, 4, 5, 6, 7, 8, 9, 10, 11:
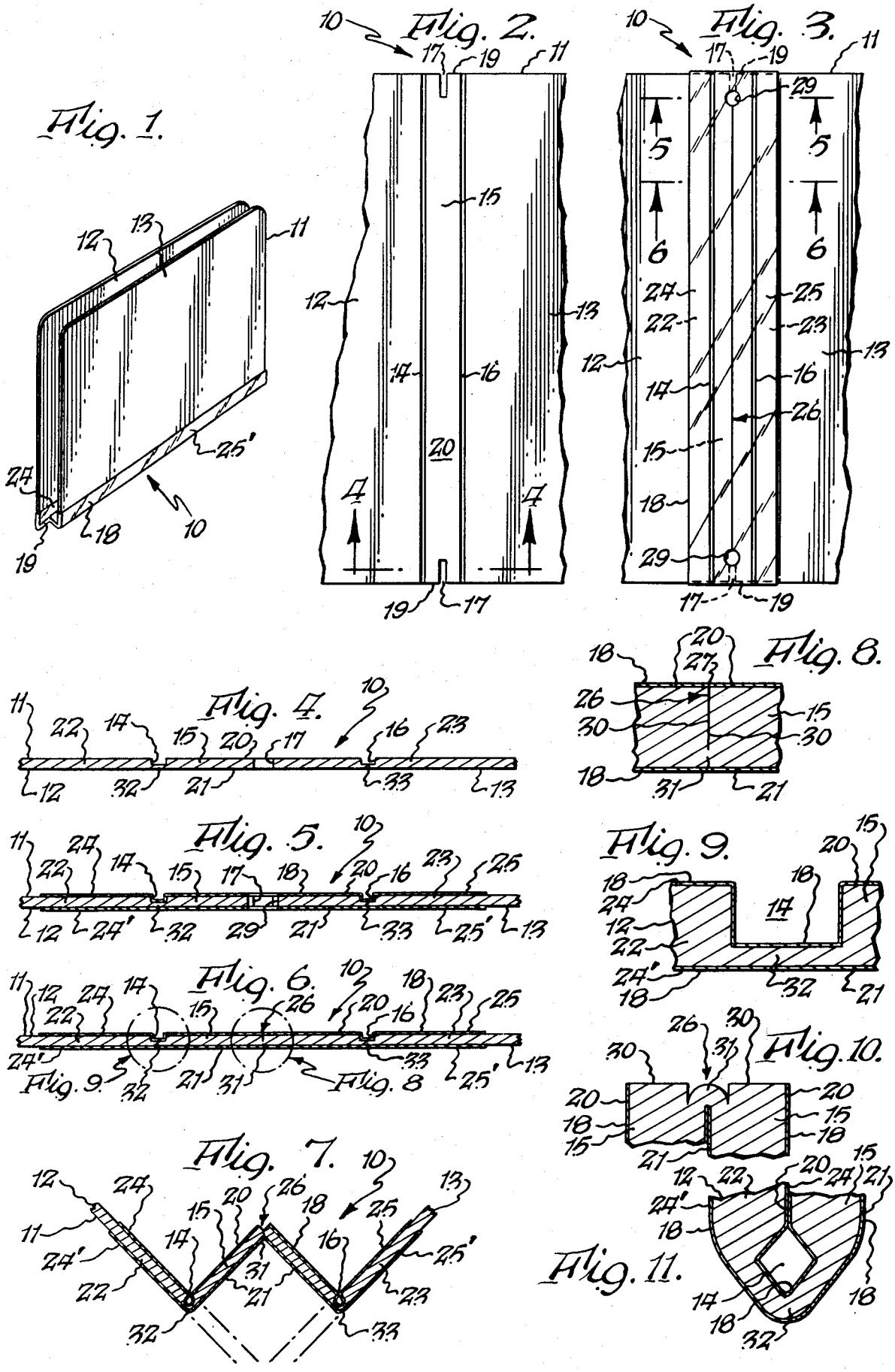
FIG. 1 is a perspective view of the improved expansion folder of the present invention.
FIG. 2 is a fragmentary plan view of the partially completed backbone structure showing the backbone portion of the folder lying in the same plane as the front and rear covers.
FIG. 3 is a fragmentary plan view similar to FIG. 2 but showing the backbone structure in completed condition.
FIG. 4 is a fragmentary cross sectional view taken substantially along line 4—4 of FIG. 2.
FIG. 5 is a fragmentary cross sectional view taken substantially along line 5—5 of FIG. 3.
FIG. 6 is a fragmentary cross sectional view taken substantially along line 6—6 of FIG. 3.
FIG. 7 is a fragmentary cross sectional view similar to FIG. 6 but showing the configuration of the backbone when the front and rear covers are moved toward the position shown in FIG. 1.
FIG. 8 is a fragmentary enlarged cross sectional view of the area depicted by the circle in FIG. 6.
FIG. 9 is a fragmentary enlarged cross sectional view of the area depicted by the circle in FIG. 6.
FIG. 10 is an enlarged fragmentary cross sectional view similar to FIG. 7 and showing the configuration of the slitted portion of the backbone when the backbone is in a fully folded position.
FIG. 11 is an enlarged fragmentary cross sectional view of the groove between the backbone and the cover when the backbone and a portion of the cover are lying in face-to-face relationship.

The improved backbone construction 10 is shown in FIG. 1, and it is an accordian-pleat type forming a part of expansion folder 11 having front cover 12 and rear cover 13. Folders of this type are generally known as pressboard expansion folders because the backbone can expand, in accordian-pleat fashion, so that the folder can accommodate different thicknesses of material therein.

The backbone 10 of folder 11 is defined by a first groove 14 which is milled between front cover 12 and backbone portion 15, and a second groove 16 which is milled between rear cover 13 and backbone portion 15. Grooves 14 and 16 are parallel to each other. The thickness of the material from which the folder 11 is made is approximately between O.020 and 0.025 inches, and the thickness of the material at grooves 14 and 16 is approximately 0.005 inches. Therefore, 0.015 to 0.020 inches of material are milled from the folder. In addition, slots 17 extend inwardly approximately ½ inch from each end 19 of the backbone, and the entire backbone is approximately 12 inches long. Slots 17 lie on the centerline between grooves 14 and 16. FIGS. 2 and 4 show the backbone and adjacent portions of the front and rear covers 12 and 13, respectively, during an intermediate step in the fabrication of the folder from a piece of planar pressboard material.

In FIG. 3 the backbone is shown in completed form. In this respect, planar plastic tape-like material 18 of a width of approximately 2 inches is adhesively secured to the entire inner surface 20 of backbone portion 15 and to the entire outer surface 21 of backbone portion 15. In addition, the planar tape-like material extends over onto and is adhesively secured to the adjacent portions 22 and 23 of covers 12 and 13, both on the insides and outsides thereof, as can be seen from FIG. 1. The backbone portion 15 is approximately 1 inch wide, and the amount that tape portions 24 and 25 extend onto front cover 12 and rear cover 13, respectively, is approximately ½ inch. It is to be especially noted that planar tape material 18 covers slots 17 (FIG. 5). It is also to be noted that the portions of the tape which overlie grooves 14 and 16 extend downwardly into the grooves, and the tape assumes this position as a result of the flexing of the leaves 12 and 13 relative to the backbone. The plastic covered grooves are in essence hinges between the backbone portion 15 and the two covers 12 and 13.

The outside portions of the tape 18 corrresponding to inner portions 24 and 25 are 24′ and 25′, respectively, and it is to be understood that portions 24 and 25 extend throughout the entire height of the folder adjacent grooves 14 and 16, respectively, and portions 24′ and 25′ also extend throughout the entire height of the folder.

After tape 18 has been adhesively secured to backbone portion 15 and to the adjacent portions of covers 12 and 13, a slit 26 is made which extends through tape 18 at 27 (FIG. 8) and continues on into backbone portion 15 for a depth so that the unslit portion 31 of backbone 15 is approximately 0.005 inches thick. Perforations 29 are made in the backbone through tape 18 and backbone portion 15 at the opposite ends of slit 26 so that perforations 29 are located between the ends of slit 26 and the inner ends of slots 17. This prevents the portions of tape 18 which overlies slots 17 from tearing. The tape 18 is preferably made of a plastic known under the trade name of MYLAR because of its strength, but other materials including fabric may be used if desired.

After fabrication of the backbone has been completed so that it comprises the structure described above with respect to FIGS. 1 and 3, the backbone portion 15 can be bent inwardly in accordian-pleat fashion to assume the configurations shown in FIGS. 1, 7 and 10. In this respect, the slit 26 and the slots 17 will permit the backbone portion 15 to fold inwardly. However, the backbone portion 15 cannot invert outwardly to the dotted-line position shown in FIG. 7 because the abutting of sides 30 (FIG. 8) of slit 26 will prevent backbone 15 from going beyond a 180° position. The fact that tape 18 is in overlying relationship and adhesively secured to outer surface 21, causes this surface to be reinforced so that even if the portion 31 (FIG. 8) between the slit 26 and surface 21 becomes fatigued, the strength of the tape 18 will cause the backbone to maintain its integrity. The grooves 14 and 16 shorten the bending radius of folder portions 32 and 33 (FIGS. 4 and 5) adjacent thereto so that the sides 12 and 13 of the folder can move relative to backbone portion 15, notwithstanding the fact that tape 18 is on both sides of the folder. In other words, the existence of grooves 14 and 15 permits the backbone portion 15 to flex inwardly relative to covers 12 and 13 so that an accordian-pleat can be formed.

The plastic tape 18 provides strength to the backbone portion and adjacent portions of the folder, and the grooves 14 and 16, in conjunction with slit 26, permit the backbone to fold in accordian-pleat fashion. The slots 17 at the ends of the backbone, permit the tape 18 to pass around the inner and outer surfaces of the backbone without either being unduly stressed, or stressing the portions of the backbone adjacent to slots 17.

It can thus be seen that the improved expansion folder of the present invention is manifestly capable of achieving the above enumerated objects, and while prefered embodiments of the present invention have been disclosed, it will be appreciated that the present invention is not limited thereto, but may be otherwise embodied within the scope of the following claims.

What is claimed is:

1. A backbone construction for a file folder having front and rear covers and a backbone integral with said covers comprising a backbone portion having an inner surface and an outer surface, a first groove between said front cover and said inner surface of said backbone portion, a second groove between said rear cover and said inner surface of said backbone portion, said first and second grooves defining the outer peripheral sides of the inner surface of said backbone portion, first and second ends on said backbone portion extending between said first and second grooves, first and second slots located between said first and second grooves and extending inwardly from said first and second ends, respectively, toward each other, planar sheet material overlying said inner surface and said first and second grooves and said first and second slots and portions of said front and rear covers adjacent to said first and second slots, a perforation located at the inner end of each of said first and second slots, respectively, and extending through said backbone portion and said planar sheet material, and an elongated slit extending between said first and second perforations and through said planar material and partially through said backbone portion on said inner surface thereof to cause said backbone portion to flex inwardly in accordian-pleat fashion between said front and rear covers.

2. A backbone construction as set forth in claim 1 wherein said planar sheet material is located both on the inside and outside of said backbone portion.

3. A backbone construction for a file folder having front and rear covers comprising a backbone portion, first and second substantially parallel hinge means between said backbone portion and said front and rear covers, respectively, for permitting said front and rear covers to pivot relative to said backbone portion, said backbone portion having inner and outer surfaces, and slit means in said inner surface of said backbone portion means extending substantially parallel to said first and second hinge means to permit said backbone portion to fold inwardly in accordian-pleat fashion between said front and rear covers.

4. A backbone construction as set forth in claim 3 including tape means on said inner surface of said backbone for reinforcing said backbone, and second slit means extending through said tape means and overlying said slit means for permitting said backbone portion to fold inwardly between said front and rear covers.

5. A backbone construction as set forth in claim 4 wherein said tape means extends onto said outer surface.

6. A backbone construction as set forth in claim 3 wherein said backbone portion includes opposite ends, first and second slots extending inwardly from said opposite ends and positioned in line with said second slit means, and perforations extending through said tape between said slots and said second slit means.

7. A backbone construction as set forth in claim 6 wherein said perforations also extend through said backbone portion.

8. A backbone construction as set forth in claim 7 wherein said tape means extends onto said outer surface.

9. A backbone construction as set forth in claim 8 wherein said perforations extend through said tape means on said outer surface.

10. A backbone construction as set forth in claim 7 wherein said tape means extends onto said front and rear covers proximate said first and second hinge means.

11. A backbone construction as set forth in claim 10 wherein said tape means extends onto said outer surface.

12. A backbone construction as set forth in claim 11. wherein said tape means extends onto said front and rear covers proximate said outer surface.

* * * * *